US005150892A

United States Patent [19]

Shimizu

[11] Patent Number: 5,150,892

[45] Date of Patent: Sep. 29, 1992

[54] SHEET FEEDING APPARATUS

[75] Inventor: Tadafumi Shimizu, Toyokawa, Japan

[73] Assignee: Minolta Camera Kabushiki Kaisha, Osaka, Japan

[21] Appl. No.: 674,911

[22] Filed: Mar. 26, 1991

[30] Foreign Application Priority Data

Mar. 30, 1990 [JP] Japan ..... 2-86671

[51] Int. Cl.[5] ..... B65H 3/14

[52] U.S. Cl. ..... 271/98; 271/104; 271/105; 271/106

[58] Field of Search ..... 271/20, 91, 92, 93, 271/98, 103, 104, 105, 106

[56] References Cited

U.S. PATENT DOCUMENTS

| | | | |
|---|---|---|---|
| 4,336,929 | 6/1982 | Hanzlik | 271/20 |
| 4,382,593 | 5/1983 | Beran et al. | 271/12 |
| 4,451,028 | 5/1984 | Holmes et al. | 271/11 |
| 4,589,647 | 5/1986 | Roller | 271/94 |
| 4,596,385 | 6/1986 | Silverberg | 271/94 |
| 4,887,805 | 12/1989 | Herbert et al. | 271/98 X |

FOREIGN PATENT DOCUMENTS

| | | | |
|---|---|---|---|
| 0361259 | 4/1990 | European Pat. Off. | 271/98 |
| 0220032 | 12/1983 | Japan | 271/12 |
| 0254438 | 11/1986 | Japan | 271/97 |
| 0093141 | 4/1987 | Japan | 271/12 |
| 0140943 | 6/1987 | Japan | 271/104 |
| 2214495 | 9/1989 | United Kingdom | 271/104 |

*Primary Examiner*—H. Grant Skaggs
*Assistant Examiner*—Carol Lynn Druzbick
*Attorney, Agent, or Firm*—Burns, Doane, Swecker & Mathis

[57] ABSTRACT

A sheet feeding apparatus comprising a sheet supporting device for supporting a stack of sheets, a vacuum transporting device adapted to suck a top sheet of the stack and transport it, and a device adapted to locate forcibly at least two portions of the top sheet away from the vacuum transporting device so as to corrugate the top sheet.

16 Claims, 3 Drawing Sheets

SHEET FEEDING APPARATUS

BACKGROUND OF THE INVENTION

1. Field of the Invention

The present invention relates to a sheet feeding apparatus in an image forming apparatus such as a copying machine, printer and others, and particularly to a feeding apparatus of a vacuum type.

2. Description of Related Art

An apparatus shown in FIGS. 5 and 6 has been known as a typical example of such sheet feeding apparatuses.

The illustrated apparatus comprises a frame 94 having air suction apertures 92 communicated with a vacuum plenum 91 and provided at its lower surface with a projected guide member 93, suction belts 97 having a large number of air suction apertures and retained around drive and driven pulleys 95 and 96 to be moved along the frame, a tray 98 disposed below the belt for supporting sheets to be fed, and a retainer member 99 disposed downward, in a sheet feeding direction, the tray for blocking advance of the sheets lower than the top sheet.

According to this apparatus, the sheets P laid on the tray 98 are sucked in sequence from the top by the suction belts 97, and are fed to an image forming section by the feeding movement of the belts in a direction indicated by an arrow f in the Figure. The lower sheet P2 which tends to be sucked and fed together with the top sheet P1 is prevented from advancing by the retainer member 99, as shown in FIG. 6.

In the prior art apparatus, the suction belts 97 extending along the frame 94 are disposed at both sides of the projected guide member 93 provided at the lower surface of the frame, so that the belts 97 relatively rapidly suck the outer portions of the top sheet P1 faced to the belts 97. The sheet P1 will not bend any longer along the guide member 93 due to the friction force between the sheet and the belt 97, so that large spaces A and B formed adjacent to the guide member 93 will be maintained. This reduces a gap between the top sheet P1 and the lower sheet P2. Therefore, the retainer member 99 cannot reliably block the advance of the lower sheet P2, which frequently causes double feeding of the sheets.

SUMMARY OF THE INVENTION

Accordingly, it is an object of the invention to provide a sheet feeding apparatus which can reliably and individually feed sheets in sequence without causing multiple transporting of the sheets.

According to the present invention, there is provided a sheet feeding apparatus comprising means for supporting or accommodating a stack of sheets to be fed; and means for feeding a top sheet of the stack.

The means for supporting or accommodating the stack of sheets may comprise at least a front side wall and a sheet support.

The means for feeding the top sheet of the stack may include vacuum transporting means having a suction section to which a negative pressure is applied, said suction section being opposed to at least a leading end of the stack of sheets and being capable of sucking the top sheet of the stack to advance it, and further, may include means adapted to locate forcibly at least two portions of the top sheet of the stack away from the suction section so as to corrugate the top sheet, said at least two portions being located in a region to be sucked by the suction section.

In addition to the vacuum transporting means, auxiliary vacuum transporting means may be provided for purposes such as ensuring of more reliable transport of the sheet and preventing of advance of the skewed sheet, in which case, for example, said vacuum transporting means may be opposed to a laterally central portion of the stack of sheets and the auxiliary vacuum transporting means may be located adjacent to the vacuum transporting means and opposed to a laterally side end portion of the stack of sheets.

Each of these vacuum transporting means and auxiliary vacuum transporting means may include, for example, a transporting belt and vacuum means.

The transporting belt has a portion, which is opposed to the top sheet of the stack and is movable in a sheet feeding direction. As an example of such belt, there is an endless belt retained around a pair of rollers. This transporting belt may be provided with a plurality of apertures for air suction. The vacuum means may be envisaged, for instance, to apply a negative pressure to the apertures in said transporting belt for sucking the air therethrough. The vacuum means may be common to both of the vacuum transporting means and the auxiliary vacuum transporting means (if provided).

The auxiliary vacuum transporting means is desired to have structure capable of selectively perform and stop its suction operation.

In this case, the auxiliary vacuum transporting means may have such structures that the suction operation thereof is activated after the top sheet of the stack is sucked by the vacuum transporting means.

Valve means may be provided for selectively activating and inactivating the above suction operation. If the vacuum transporting means and the auxiliary vacuum transporting means comprise transporting belts having a plurality of air suction apertures, and the vacuum means is adapted to apply a negative pressure to the apertures in these transporting belts for sucking the air therethrough, the valve means is designed to selectively activate and inactivate the air suction operation to be performed through the apertures in the transporting belt of the auxiliary vacuum transporting means.

Further, such structures can be envisaged that, after the transporting belt of the vacuum transporting means sucks the top sheet of the stack, the auxiliary vacuum transporting means can start the air suction operation through the apertures in the transporting belt of the auxiliary vacuum transporting means.

As a specific example, the valve means may include a plate member movable between a position for activating the air suction operation and a position for inactivating it.

The means for corrugating the top sheet of the stack may be, for example, guide means having a pair of projections which project toward the top sheet and are spaced from each other in a direction perpendicular to the feeding direction of the sheet. If the vacuum transporting means includes the transporting belt, a pair of these projections are disposed at both sides of this belt.

The sheet feeding apparatus of the invention may comprise sheet retainer means for preventing advance of the sheets other than the top sheet of the stack which are forced to advance by the feeding means for the top sheet of the stack.

This retainer means may be, for instance, a sheet retainer member, which is disposed at a downstream side in the sheet feeding direction with respect to a leading end of the stack of sheets, and is adapted to block the advance of the sheets other than the top sheet of the stack to be fed.

For this purpose, if the sheet supporting or accommodating means has the front side wall as described above, this wall can be utilized as the sheet retainer means. If a member such the front side wall or other plate member is used as the sheet retainer member, this member is disposed to be opposed to a space between a pair of the projections of the guide means for corrugating the sheet, and an upper surface of the retainer member is located at a level higher than lower surfaces of a pair of the projections.

Further, the apparatus of the invention may comprise air injection means which is opposed to the leading end of the stack of sheets and is adapted to inject the air toward this leading end for reliable separation of the sheets.

This air injection means may be envisaged, for instance, to inject the air toward a laterally outer portion of the leading end of the stack of sheets located outside, in the lateral or widthwise direction of the stack of sheets, the means for corrugating the top sheet of the stack, and toward the portions outside a pair of the projections, if these are provided in the corrugating means.

As a specific example, the air injection means may have structures which are effective as sheet separating means, and more particularly, which have a first air injection section located downstream, in the sheet feeding direction, the leading end of the stack of sheets for injecting the air obliquely upward toward the leading end of the stack of sheets, and a second air injection section for injecting the air substantially horizontally forward the leading end of the stack of sheets.

Other objects and advantages of the present invention will become more apparent from the following detailed description, when taken in conjunction with the accompanying drawings which show, for the purpose of illustration only, embodiments in accordance with the present invention.

DETAILED DESCRIPTION OF THE PREFERRED EMBODIMENTS

Embodiments of the invention will be described below with reference to the drawings.

The embodiments described hereinafter can be applied to copying machines, printers and others.

Figure 1:
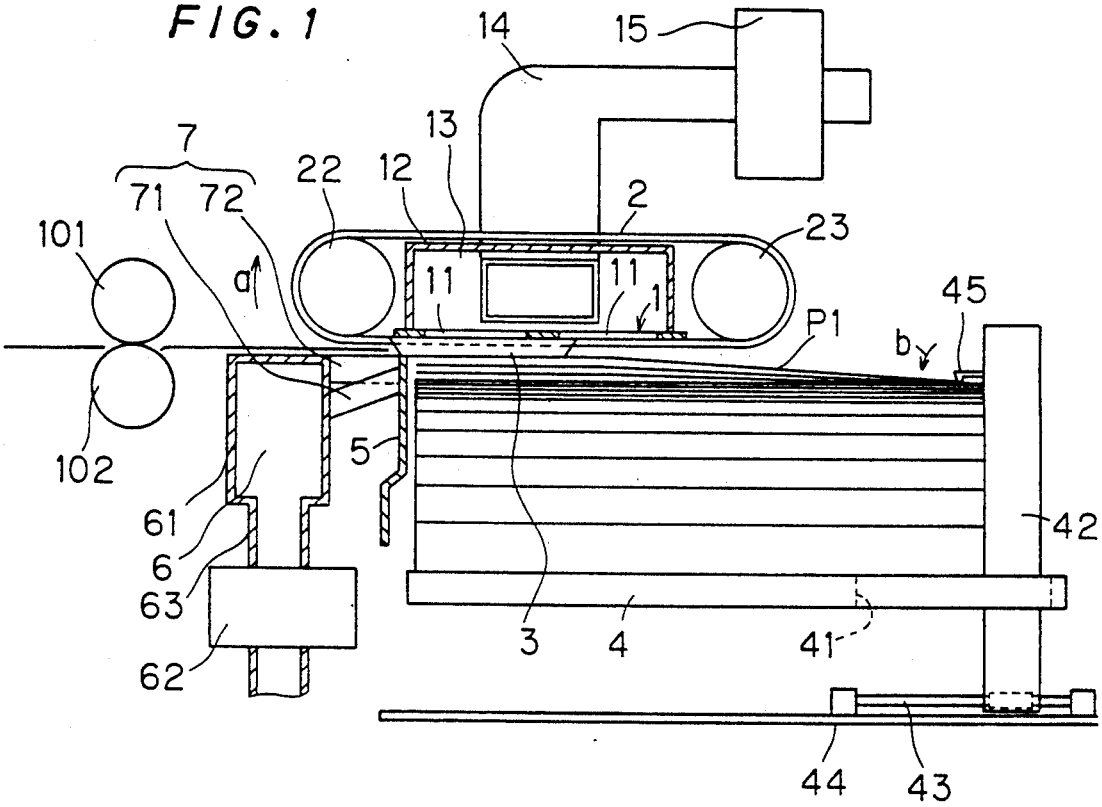
FIG. 1 is a partially sectional side view illustrating a sheet feeding apparatus according to the invention.
Figure 2:
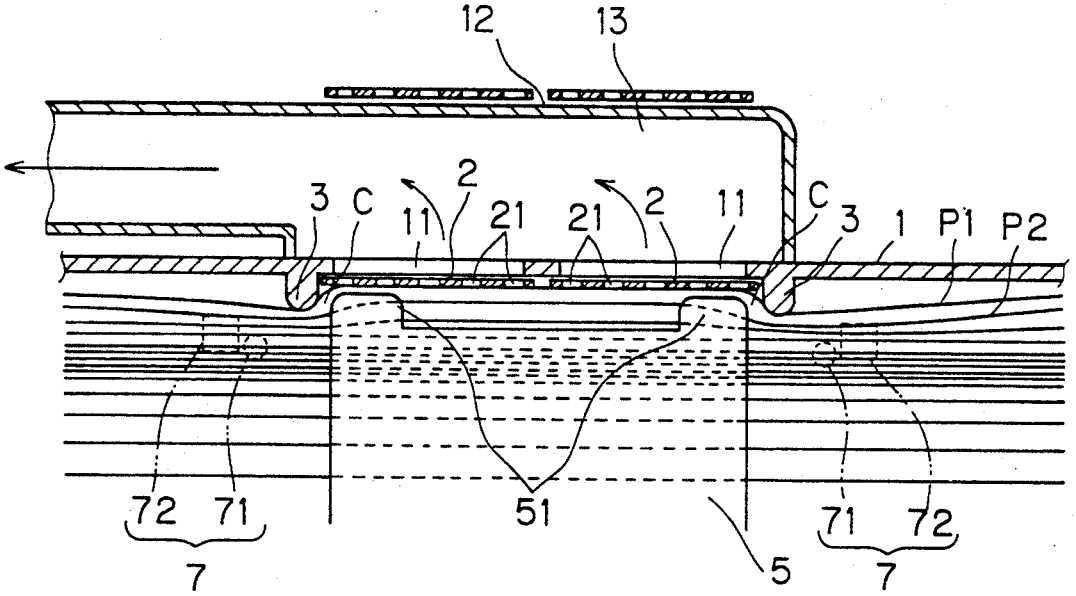
FIG. 2 is a cross section of a major part of an apparatus in FIG. 1 viewed from a downstream side in a sheet feeding direction.

A first embodiment of the invention will now be described with reference to FIGS. 1 and 2. FIG. 1 is a cross section of a sheet feeding apparatus, and FIG. 2 is a view of the sheet feeding apparatus viewed from a downstream side thereof in a sheet feeding direction.

This sheet feeding apparatus includes a frame 1 and two suction belts 2 moving along the frame. The frame 1 includes air suction apertures 11. The belts 2 include a large number of air suction apertures 21 throughout its peripheral surfaces, respectively.

A wall 12 is coupled to the frame 1 to form a vacuum plenum 13 therein. The air in the vacuum plenum 13 is sucked through a duct 14 by a fan 15. Thereby, the air outside the vacuum plenum 13 is continuously sucked into the vacuum plenum 13 to apply a negative pressure to the air suction apertures 11 and the air suction apertures 21 in the belts 2.

The two belts 2 are retained around a drive roller 22 which is driven by a motor (not shown) and a driven roller 23, so that they are moved in a direction indicated by an arrow a in the Figure by rotation of the drive roller 22 along a lower surface of the frame 1 through a region opposed to the air suction apertures 11 in the frame 1.

The frame 1 is provided at the lower surface with a pair of projected guide members 3 which are spaced from each other, as shown in FIG. 2. The air suction apertures 11 and the two belts 2 are disposed between a pair of the guide members 3.

A tray 4 for supporting sheets (paper sheets in the illustrated embodiment) is disposed below the belts 2 and is adapted to be vertically moved by drive means (not shown) along a guide(s) (not shown).

The tray 4 is provided with a member 42 which extends through a hole 41 in the tray and serves to align trailing edges of the sheets. The position of the member 42 can be adjusted in the sheet feeding direction along a pair of guide rods 43 (only one is illustrated in the Figure) extending in the sheet feeding direction and is positioned within a region in the aperture 41 depending on sizes of the sheets. The guide rods 43 are supported by a frame 44.

The member 42 is provided at its upper portion with a lever 45, which is biased to pivot in an illustrated direction b by spring means (not shown) to contact a top surface of the stack on the tray 4, and thus to prevent floating of the rear edges of the sheets, which may be caused by the air injected from an air nozzle device described later. The lever 45 includes detecting means (not shown) for detecting whether the top surface of the stack of sheets on the tray 4 is located at a predetermined level. If the top surface of the stack of sheets is not located at the predetermined level, the tray 4 will be moved to the predetermined level by the unillustrated tray driving means.

In front of the leading edges (forward edges) of the stacked sheets, there is arranged a retainer member 5 for preventing advance of the sheet P2 under the top sheet P1. As clearly shown in FIG. 2 viewed from the downstream side in the sheet feeding direction, the retainer member 5 has upwardly projected portions 51 at opposite ends of its upper edge. The retainer member 5 is so disposed that top surfaces of the projected portions 51 are located between the paired projected guide members 3 at a level higher than the lower surfaces of the projected guide members 3.

At a position further downstream of the retainer member 5, in the sheet feeding direction, there is arranged a positive pressure plenum 6 enclosed by a wall 61. The air is supplied into this positive pressure plenum 6 by a fan 62 through a duct 63 so as to maintain the positive pressure therein. The pressurized air in the positive pressure plenum 6 is injected from the air nozzle device 7 communicated therewith onto the leading ends of the upper sheets of the stack on the tray 4.

The air nozzle device 7 includes, as shown in FIG. 2, two sets of nozzles, each set having a floating nozzle 71 and a separating nozzle 72. Each set of nozzles 71 and 72 have air injection ports, which are disposed laterally outside the projected guide member pair 3 and downstream, in the sheet feeding direction, the tray 4, and are opposed to the leading ends of the upper sheets of the stack on the tray 4. The floating nozzles 71 are disposed slightly lower than the separating nozzles 72, respectively. The floating nozzles 71 inject the air obliquely upward toward the leading ends of the stacked sheets, while the separating nozzles 72 inject the air substantially horizontally so as to separate the sheets lifted by the air from the floating nozzles from each other.

In FIG. 1, numerals 101 and 102 indicate a pair of transporting rollers for transporting the sheets sent from the feeding apparatus to the image forming section.

According to the sheet feeding apparatus described hereinabove, the floating nozzles 71 inject the air against the leading edges (downstream edges in the sheet feeding direction) of the upper sheets laid on the tray 4, so that a few upper sheets of the stack are lifted, and the top sheet and the remainder of the sheets are separated from each other by the air injected between the sheets. The top sheet P1 thus separated is sucked onto the belts 2, owing to the suction of the air between the belts 2 and the sheet P1 by the vacuum plenum 13 through the apertures 11. In this operation, the portions of the sheet P1 located outside the projected guide members 3 are not subject to the suction force, so that the sheet P1 which is brought into contact with the projected guide member pair 3 is lifted and deformed into an inverted concave shape (i.e., corrugated shape) along the guide members 3 and the lower surfaces of the suction belts, and the portion of the sheet 1 between the projected guide members is sucked onto the belts 2. Both sides or edges of the top sheet P1 and the lower sheet P2 located outside the projected guide member pair 3 are floated higher than the lower surfaces of the guide members 3 by the air injected from the separating nozzles 72 located outside the guide member pair 3.

In this manner, the first sheet P1 comes into closely contact with the belts 2 and is held higher than the retainer member 5. On the other hand, the second and subsequent sheets P2 are floated at regions outside the guide member pair 3, so that the second sheet P2 cannot be in closely contact with the top sheet P1 at regions near the inner sides of the respective guide members 3 due to the rigidity of the paper sheet. Therefore, the sheet P2 is separated from the sheet P1 and remains at a position lower than the upper edge of the retainer member 5. In this manner, the retainer member 5 allows feeding of the sheet P1 by the movement of the belts 2 to the image forming section, and reliably prevents the contact of the lower sheet P2 with the top sheet and the advance of the sheet P2.

The operations described above are repeated to ensure the individual and sequential feeding of the sheets.

The nozzle device 7 is disposed outside the projected guide members 3 for following reasons. If it were disposed in the region between the two guide members 3, the air pressure caused by the air flowing into the space between the two guide members 3 would lift not only the top sheet but also the lower sheet, which would impede the separation by the retainer member 5.

Figure 3:
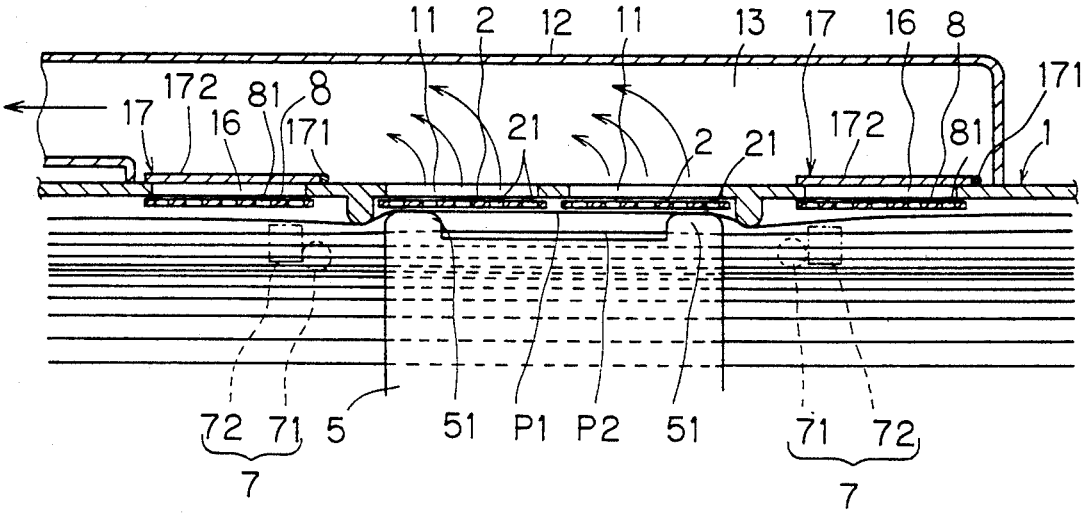
FIG. 3 is a cross section of a major part of a sheet feeding apparatus of another embodiment according to the invention, viewed from the downstream side in the sheet feeding direction, illustrating a condition prior to opening of valve means.
Figure 4:
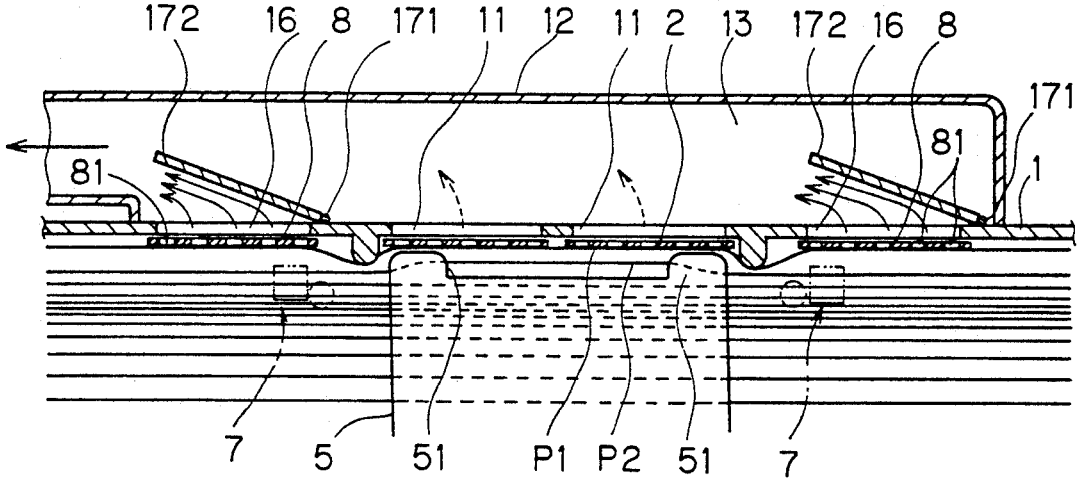
FIG. 4 is a cross section of a major part of a sheet feeding apparatus of another embodiment in FIG. 3, viewed from the downstream side in the sheet feeding direction, illustrating a condition after opening of valve means.
Figure 5:
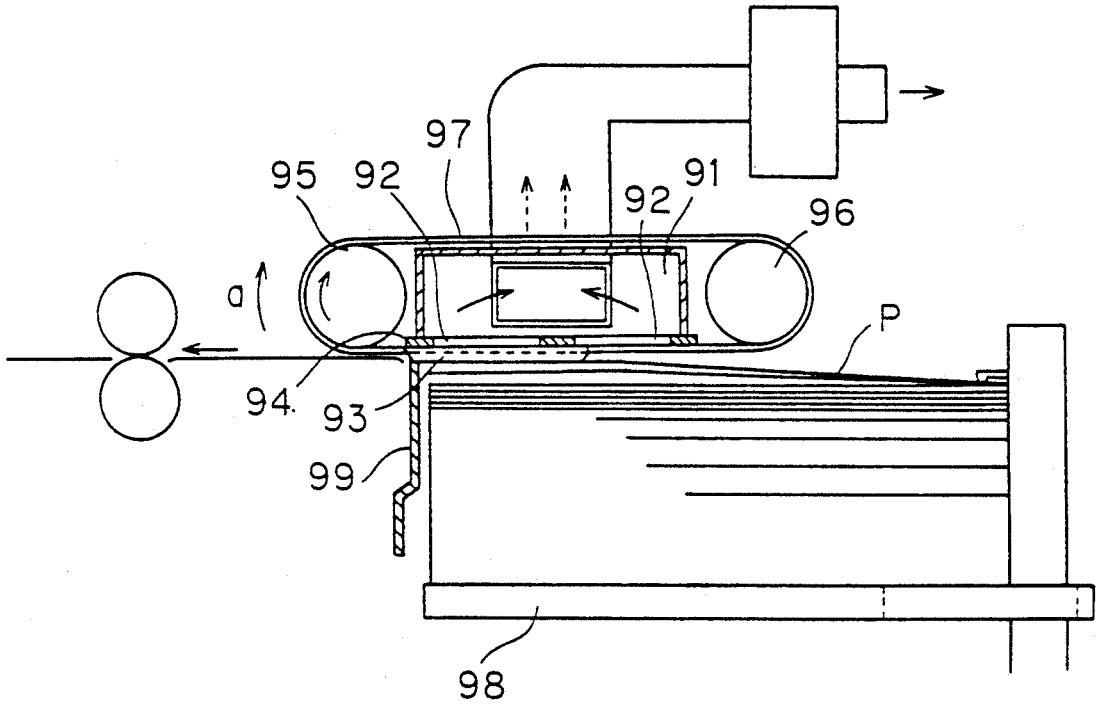
FIG. 5 PRIOR ART
FIG. 5 is a partially sectional side view illustrating a sheet feeding apparatus of the prior art.
Figure 6:
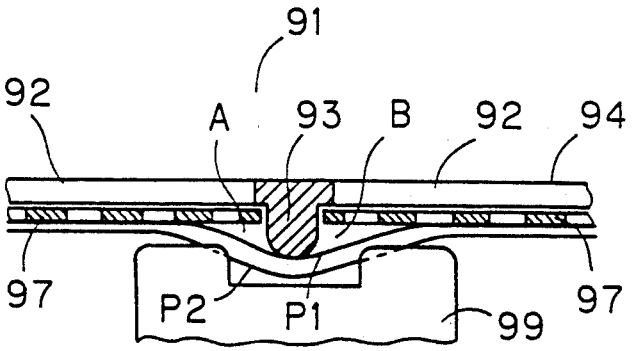
FIG. 6 PRIOR ART
FIG. 6 is a fragmentary enlarged cross section of an apparatus of the prior art.

Then, another embodiment of the invention will be described with reference to FIGS. 3 and 4.

This embodiment comprises, in addition to the components in the first embodiment described hereinabove, air suction apertures 16 communicating with the vacuum plenum 13 located at portions of the frame 1 outside the projected guide members 3, valve means 17 for closing the apertures 16 and suction belts 8 opposed to the respective air suction apertures 16. Thus, the vacuum plenum 13 is larger than that in the first embodiment. Further, the drive and driven rollers 22 and 23 for carrying the suction belts are longer than those in the first embodiment.

The suction belts 8 are retained around the drive and driven rollers 22 and 23 around which the suction belts 2 are also retained, and thus the belts 8 move together with the belts 2.

Each valve means 17 is formed of a plate 172 pivotably connected to the frame 1 through a hinge 171. This plate 172 lowers to close the air suction aperture 16 owing to its own weight when the air suction apertures 11 between the projected guide members 3 are in communication with the atmosphere through the apertures 21 in the belts 2. When the belts 2 closely attract the sheets and the air pressure in the vacuum plenum 13 is reduced, the difference in pressure between the exterior and interior of the vacuum plenum 13 serves, as shown in FIG. 4, to pivot the plates 17 upward, so that the ambient air is sucked into the vacuum plenum 13 through the air suction apertures 81 in the belts 8.

In this sheet feeding apparatus, the leading edges of the upper sheets laid on the tray 4 are lifted and separated from each other by the air from the floating nozzles 71 and the separating nozzles 72. In this condition, the air suction apertures 16 in the frame 1 are closed by the plates 172 which lowers under the gravity.

As already described, the top sheet P1 which is sucked toward the belts 2 is not subject to the suction force at the portions outside the projected guide members 3, and thus the portion between the projected guide members 3, i.e., the central portion of the sheet is sucked onto the belts 2, so that it is in closely contact with the lower surfaces of the belts 2 and the guide member pair 3. While the top sheet P1 is being sucked onto the belts 2 in this manner, it forms a sufficient space at a region inside each guide 3 with respect to the lower sheet P2. Immediately after the top sheet P1 is sucked onto the belts 2 and is lifted to have the inverted concave shape (corrugated shape) as described above, the plates 172 of the valve means 17 are pivoted upward by the ambient pressure owing to the reduction of the pressure in the vacuum plenum 13, so the apertures 81 in the suction belts 8 and the apertures 16 in the frame 1 communicate with the vacuum plenum 13. Thereby, the portions of the sheet P1 faced to the suction belts 8 are sucked onto the belts 8, respectively. Thus, not only the sheet P1 without a curl but also the curled sheet P1 can be held by the belts 2 and 8 through a large area and thus fed to the image forming section while maintaining a correct position. Further, since the large area of the sheet P1 is sucked onto the belts 2 and 8, skew of the sheet during the transportation can be prevented.

On the other hand, the sheet P2 and others lower than the top sheet P1 are reliably prevented from advancing by the retainer member 5.

As the top sheet P1 advances in accordance with the feeding movement of the belts 2 and 8, the air suction apertures 11 in the frame 1 start to open through the apertures 21 in the belts to the atmosphere, so that the plates 172 in the valve means 17 pivots under the gravity to reclose the apertures 16.

The operations described above are repeated to reliably feed the sheets on the tray 4 in sequence to the image forming section without the skew.

It will be understood that the invention is not restricted to the embodiments described above, and may be practiced in various forms.

For example, although the embodiments described above each include the one projected guide member pair 3, each may include two or more pairs. However, if the two or more pairs are employed, it is necessary to form a sufficiently large space between the adjacent projected member pairs for achieving the suction of the sheet in the inverted concave shape described before by each projected guide member pair.

Although the embodiments described above include the nozzle device formed of the floating nozzles and the independent separatiig nozzles, common nozzles which serve as both the floating and separating nozzles may be employed. The nozzle device is not essential.

Further, instead of the valve means 17 associated to the frame 1 in the above second embodiment, other appropriate valve means may be employed. As an example of the other envisaged valve means, slidable plates which are driven by a solenoid(s) for selectively opening and closing the frame apertures 16 may be employed, in which case turning on and off of the solenoid(s) may be controlled, using a timer.

In any case, the valve means is constructed so that a peak in the sheet suction through the air apertures faced to the valve means may be attained after the actual suction of the sheet by the belts 2 between the guide members 3.

What is claimed is:

1. A sheet feeding apparatus comprising:

sheet supporting means for supporting a stack of sheets to be fed;

vacuum transporting means opposed to at least a leading end of said stack of sheets and adapted to suck a top sheet of said stack to advance it, said vacuum transporting means having a suction section to which a negative pressure is applied; and means adjacent said vacuum transporting means for contacting at least two portions of said top sheet of said stack, which two portions are located in a region to be sucked by said suction section, so as to retain said two portions at a distance from said suction section so as to corrugate said top sheet;

wherein said vacuum transporting means is opposed to a laterally central portion of said stack of sheets, and auxiliary vacuum transporting means is located adjacent to said vacuum transporting means and opposed to a laterally side end portion of said stack of sheets.

2. An apparatus as claimed in claim 1, wherein said auxiliary vacuum transporting means is adapted to selectively perform and stop its suction operation.

3. An apparatus as claimed in claim 2, wherein said auxiliary vacuum transporting means is adapted to perform said suction operation thereof after said top sheet of said stack is sucked by said vacuum transporting means.

4. An apparatus as claimed in claim 1, wherein said vacuum transporting means and said auxiliary vacuum transporting means have endless belts, respectively, and have a pair of roller carrying these belts.

5. A sheet feed apparatus comprising:

sheet supporting means for supporting a stack of sheets;

a frame provided so as to confront a top sheet of said stack and having a lower surface with a plurality of openings therein for air suction;

a transporting belt disposed around said frame so as to be movable in a sheet feeding direction, and having a plurality of apertures at its surface for air suction;

vacuum means for applying negative pressure to said openings and apertures so as to suck air therethrough; and a pair of projections provided at the lower surface of the frame and projecting toward said top sheet of said stack, said projections being spaced from each other in a direction perpendicular to the sheet feeding direction so as to guide the moving transport belt between the projections;

wherein said lower surface extends directly between said projections and said plurality of openings.

6. An apparatus as claimed in claim 5, further comprising a sheet retainer member, which is disposed at a downstream side in the sheet feeding direction with respect to a leading end of said stack of sheets, and is adapted to block advance of said sheets other than said top sheet of said stack to be fed by said transporting belt.

7. An apparatus as claimed in claim 6, wherein said sheet retainer member is a plate member which is disposed between said projections and has an upper surface located at a level higher than a lower surface of said projections.

8. An apparatus as claimed in claim 5, further comprising air injection means which is opposed to said leading end of said stack of sheets and is adapted to inject air toward said leading end of said stack of sheets.

9. An apparatus as claimed in claim 8, wherein said air injection means is adapted to inject the air toward a portion of said stack of sheets located outside a pair of said projections.

10. A sheet feeding apparatus comprising:

sheet supporting means for supporting a stack of sheets;

first transporting belt having a portion which is opposed to a top sheet of said stack and is movable in a sheet feeding direction, and a plurality of apertures at its surface for air suction;

second transporting belts having portions which are opposed to a top sheet of said stack and are movable in a sheet feeding direction, said second transporting belts being arranged at both sides of said first transporting belt along said first transporting belt and having a plurality of apertures at their surfaces for air suction;

guide means having a pair of projections which project toward said top sheet of said stack and are spaced from each other in a direction perpendicular to the feeding direction of said sheet with said first transporting belt therebetween;

vacuum means for applying a negative pressure to said apertures in said first and second transporting belts so as to suck the air therethrough; and valve means for selectively activating and inactivating a suction operation through said plurality of apertures in selected one of said second transporting belts.

11. An apparatus as claimed in claim 10, further comprising a sheet retainer member, which is disposed at a downstream side in the sheet feeding direction with respect to a leading end of said stack of sheets, and is adapted to block advance of said sheets other than said top sheet of said stack to be fed by said first and second transporting belts.

12. An apparatus as claimed in claim 11, wherein said sheet retainer member is a plate member which is disposed to be opposed to a space between a pair of said projections and has an upper surface located at a level higher than lower surfaces of a pair of said projections.

13. An apparatus as claimed in claim 10, further comprising air injection means which is opposed to said leading end of said stack of sheets and is adapted to inject air toward said leading end of said stack of sheets.

14. An apparatus as claimed in claim 13, wherein said air injection means is adapted to inject the air toward a portion of said stack of sheets located outside a pair of said projections.

15. An apparatus as claimed in claim 10, wherein said valve means is adapted to start the air suction operation through said apertures in said second transporting belts after said first transporting belt sucks said top sheet of said stack.

16. A sheet feeding apparatus comprising:

sheet supporting means for supporting a stack of sheets;

a first transporting belt having a portion which is opposed to a top sheet of said stack and is movable in a sheet feeding direction, and a plurality of apertures at its surface for air suction;

second transporting belts have portions which are opposed to a top sheet of said stack and are movable in a sheet feeding direction, said second transporting belts being arranged at both sides of said first transporting belt along said first transporting belt and having a plurality of apertures at their surfaces for air suction;

guide means having a pair of projections which project toward said top sheet of said stack and are spaced from each other in a direction perpendicular to the feeding direction of said sheet with said first transporting belt therebetween;

vacuum means for applying a negative pressure to said apertures in said first and second transporting belts so as to suck the air therethrough; and valve means which includes a plate member movable between a position for activating the air suction operation performed through said apertures in said second transporting belts and a position for inactivating it.

* * * * *